United States Patent [19]

Bivona

[11] 4,206,558

[45] Jun. 10, 1980

[54] EXERCISE SHOES FOR SIMULATED JOGGING

[75] Inventor: Vincent J. Bivona, Hazlet, N.J.

[73] Assignee: Vin-Lyn Enterprises, Inc., Edison, N.J.

[21] Appl. No.: 950,037

[22] Filed: Oct. 10, 1978

[51] Int. Cl.[2] ..... A63B 1/00; A43B 3/12

[52] U.S. Cl. ..... 36/7.5; 36/11.5; 272/70

[58] Field of Search ..... 36/1, 11.5, 7.5; 272/70, 57 D

[56] References Cited

U.S. PATENT DOCUMENTS

| | | | |
|---|---|---|---|
| 2,283,595 | 5/1942 | Banister | 36/7.5 |
| 2,810,213 | 10/1957 | Jonas | 36/1 |
| 3,061,951 | 11/1962 | Barron | 36/7.5 |
| 3,584,402 | 6/1971 | Silverman | 36/7.5 |

*Primary Examiner*—Patrick D. Lawson

*Attorney, Agent, or Firm*—Pennie & Edmonds

[57] ABSTRACT

An exercise shoe for wear on a human foot during simulated jogging comprises a foot support platform characterized by a substantially planar foot support surface, a sharper-than-circular curved bottom surface for providing forward-breaking and backward-breaking motions during simulated jogging and means for attaching the platform to a foot. In a preferred embodiment, the bottom surface is substantially hyperbolic.

5 Claims, 4 Drawing Figures

EXERCISE SHOES FOR SIMULATED JOGGING

TECHNICAL FIELD

This invention relates to exercise devices and, in particular, to exercise shoes for simulated jogging.

BACKGROUND ART

The beneficial effects of jogging are now well established. It is now widely recognized that jogging for a sufficient distance at a sufficient speed produces a measurable improvement in the efficiency of the cardiorespiratory organs of the human body as well as improving the tone of muscles in the ankles, legs, hips, and abdomen. The value of this conditioning carries over to enhance performance in numerous other recreational activities such as tennis, soccer, and skiing. In addition, the caloric expenditure involved can, when coupled with proper diet, provide an important supplementary means of weight control.

Unfortunately, in the northern climates, jogging is necessarily a seasonal activity confined to the warmer seasons of the year. Many weeks are spent each spring reachieving, with some physical strain and risk to health, the muscle tone and level of endurance lost during the winter.

Indoor running-in-place is one recognized alternative to outdoor jogging in maintaining cardiorespiratory endurance, but it does not exercise all of the muscles required either for outdoor jogging or for related recreational activities involving running. The essence of outdoor jogging is a propulsion forward, and no such effort can be utilized in stationary running. Since the tolerable duration of exercise is limited by the weakest muscle group, even the stationary runner finds himself faced with the necessity of retoning a number of weak muscles, ligaments, and cartilages at the beginning of warm weather.

Treadmills are one possible solution to this problem. Unfortunately, they are expensive and beyond the means of most people. Moreover, even in an institutional setting they are of little use to many because each treadmill can be used by only one or two people at a time.

Accordingly, there is a substantial need for a simple, inexpensive exercise device for aiding a person to exercise, indoors, those muscles used in outdoor jogging and running.

DISCLOSURE OF THE INVENTION

Applicant has discovered that by the use of simple curved-soled exercise shoes of proper shape, a stationary runner can more specifically exercise those muscles used in outdoor jogging and, thus, obtain, indoors, the benefit of outdoor jogging and minimize the difficulties of transition between the two forms of exercise. More specifically, the exercise shoes have substantially planar foot support surfaces and sharper-than-circular, smooth, curved bottom surfaces for providing, from a substantially level equilibrium position during rest, distinct forward-breaking and backward-breaking motions during exercise. These motions require the exerciser to use, in stationary running, those muscles of the ankles, legs, hips, and abdomen which he would use during the forward propulsion stage of outdoor jogging and running.

BRIEF DESCRIPTION OF THE DRAWINGS

The nature, advantages, and various additional features of the invention will appear more fully upon consideration of the illustrative embodiments now to be described in detail in connection with the accompanying drawings.

In the drawings.

BEST MODE FOR CARRYING OUT THE INVENTION

Figure 1:
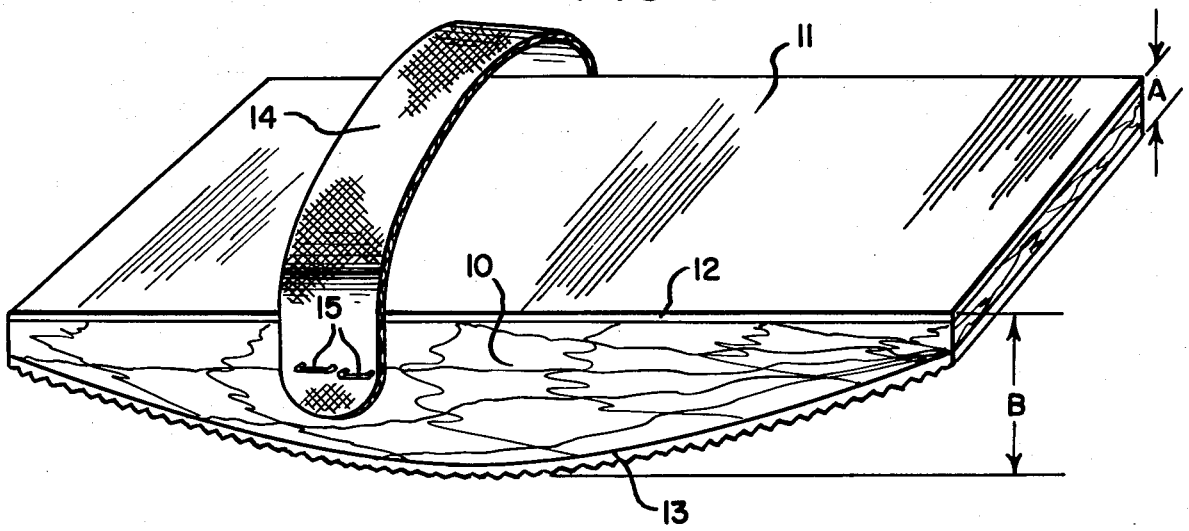
FIG. 1 is a perspective view of a preferred exercise shoe in accordance with the invention.

Referring to the drawings, FIG. 1 is a perspective view of an exercise shoe in accordance with the invention comprising a body 10, such as wood or molded plastic, having a substantially flat upper foot support surface 11, advantageously covered by a thin ⅛" (3.175 mm) layer 12 of firmly supporting foam, and a curved lower surface 13, conveniently provided with a non-skid texture as by use of a textured plastic laminated to the body. The platform is dimensioned to substantially coincide with a typical human foot, and a strap 14, such as rubberized nylon reinforced webbing, is secured to the platform on either side, as by staples 15, to hold the platform on an individual foot during exercise.

The curvature of preferred surface 13 is smooth, to avoid moments of undue strain, but sharper than the curve of a circle defined by the end points and apex of the curve. The form of this empirically determined curve is substantially hyperbolic with a smooth curve at the center smoothly leading into a pair of substantially linear regions extending to each end. With such curvature, one engaging in stationary jogging wearing a pair of the shoes is aware of distinct forward and backward breaking motions as the platform smoothly breaks over the center curve toward the linear support regions on either side. It is this motion and the resulting horizontal thrust component that exercises, during stationary jogging, those muscles used in the forward propulsion portion of outdoor jogging.

Figure 2A:
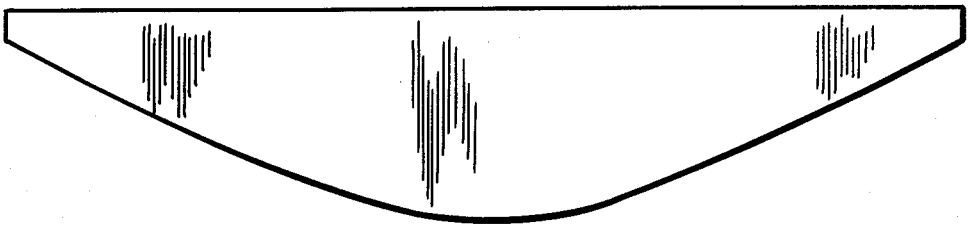
FIGS. 2A, 2B, and 2C are schematic cross sections, respectively, of the maximum, preferred, and minimum curvatures for the bottom surfaces of exercise shoes in accordance with the invention.
Figure 2B:
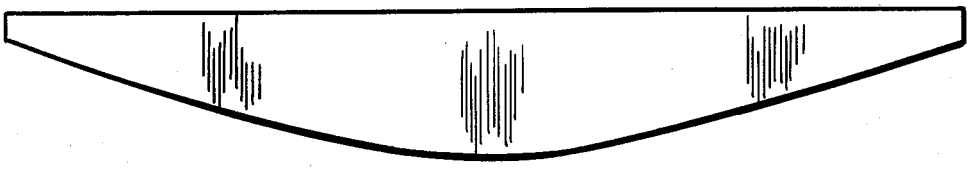
Figure 2C:
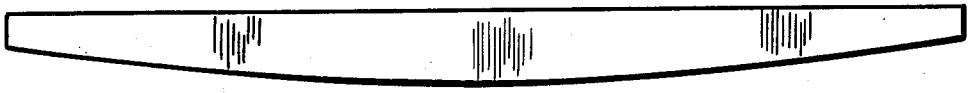

FIGS. 2A, 2B, and 2C illustrate, respectively, the empirically determined maximum, preferred, and minimum curvatures useful in this invention. The ratios of minimum thickness A to maximum thickness B of the three curvatures are approximately 1:8; 1:4; and 1:2, respectively, on a platform approximately 10 inches (254 mm) long and 3½ inches (88.9 mm) wide.

While the invention has been described in connection with a small number of specific embodiments, it is to be understood that these are merely illustrative of the many other specific embodiments which can also utilize the principles of the invention. Thus, numerous and varied devices can be made by those skilled in the art without departing from the spirit and scope of the present invention.

I claim:

1. An exercise shoe for wear on a human foot during simulated jogging, comprising a foot support platform characterized by a substantially planar foot support surface; a bottom surface having a sharper than circular center portion smoothly leading to substantially linear regions extending to each end, for providing forward-breaking and backward-breaking motions during simulated jogging, and means for attaching said platform to such foot.

2. An exercise device according to claim 1 wherein said curved bottom surface is substantially hyperbolic.

3. An exercise device according to claim 1 wherein said curved bottom surface is provided with a non-skid texture.

4. An exercise device according to claim 1 wherein said planar foot support surface is provided with a thin layer of firmly supporting foam.

5. An exercise device according to claim 1 wherein the ratio of the minimum thickness to the maximum thickness of said platform is in the range between about 1:8 and 1:2.

* * * * *